US006845923B1

(12) United States Patent
Slotsve

(10) Patent No.: US 6,845,923 B1
(45) Date of Patent: Jan. 25, 2005

(54) ERGONOMIC HOPPER HOLDER

(76) Inventor: Robert R. Slotsve, 499 S. Glen Trail, Lino Lakes, MN (US) 55014

( * ) Notice: Subject to any disclaimer, the term of this patent is extended or adjusted under 35 U.S.C. 154(b) by 0 days.

(21) Appl. No.: 10/698,146

(22) Filed: Oct. 31, 2003

(51) Int. Cl.[7] ..... B05B 9/08

(52) U.S. Cl. ..... 239/376; 239/152; 239/280; 239/280.5; 239/281; 239/375; 239/377; 239/378; 239/379; 239/532; 239/DIG. 14; 248/76; 248/80; 248/128; 224/185; 224/262; 222/174; 222/175

(58) Field of Search ..... 239/152, 153, 239/154, 650, 653, 273, 280, 280.5, 281, 345, 346, 357, 375, 376, 377, 378, 379, 532, DIG. 14; 224/185, 262, 922; 248/76, 80, 82, 83, 117.2, 128; 222/173, 174, 175

(56) References Cited

U.S. PATENT DOCUMENTS

| | | | | | |
|---|---|---|---|---|---|
| 930,087 | A | * | 8/1909 | Reich | 239/345 |
| 1,873,672 | A | * | 8/1932 | Theys | 248/83 |
| 3,140,800 | A | * | 7/1964 | Henderson | 222/174 |
| 3,191,826 | A | * | 6/1965 | Adams | 224/185 |
| 3,945,571 | A | | 3/1976 | Rash | |
| 4,023,711 | A | * | 5/1977 | Sena | 239/532 |
| 4,364,521 | A | | 12/1982 | Stankowitz | |
| 4,434,939 | A | | 3/1984 | Stankowitz | |
| 4,511,063 | A | | 4/1985 | Krause et al. | |
| 4,863,104 | A | | 9/1989 | Masterson | |
| 4,948,054 | A | | 8/1990 | Mills | |
| 5,415,351 | A | | 5/1995 | Otto et al. | |
| 5,727,736 | A | | 3/1998 | Tryon | |
| 5,979,797 | A | | 11/1999 | Castellano | |
| 6,070,809 | A | * | 6/2000 | Price | 239/273 |
| 2002/0014563 | A1 | | 2/2002 | Lucero | |
| 2002/0175222 | A1 | | 11/2002 | Vaage | |

* cited by examiner

*Primary Examiner*—Robin O. Evans
(74) *Attorney, Agent, or Firm*—Walter K. Roloff

(57) ABSTRACT

An ergonomic hopper holder for use with spray application equipment includes a vertical support member having a holster end, an opposite hopper end, and a hopper hanger proximate to the hopper end. The holder also includes an arm member having a support end, a spray gun end, and a spray gun support proximate to the spray gun end for supporting a spray gun. The arm member is pivotably joined to the vertical support member. The holder further includes a holster and belt combination capable of being worn by an artisan.

3 Claims, 5 Drawing Sheets

ERGONOMIC HOPPER HOLDER

FIELD OF THE INVENTION

The present invention relates generally to pneumatic spray application equipment. The invention relates specifically to an ergonomic hopper holder for use with pneumatic spray application equipment.

BACKGROUND OF THE INVENTION

Pneumatic spray application equipment is well known, and has enjoyed wide commercial success particularly in the construction trades. Specifically, such equipment is commonly used by interior finishing artisans for rapid and uniform deposition of textured ceiling material onto bare ceiling surfaces and the like.

Typically, spray application equipment consists of a source of pressurized air, a pressurized air conduit or line coupled to the source, a spray gun pneumatically coupled to the air line, and a supply hopper coupled to the gun which holds and contains material to be sprayed and deposited by the artisan. Examples of such equipment, accessories therefor, and related devices are disclosed in U.S. Pat. No. 3,945,571 issued to Rash; U.S. Pat. No. 4,364,521 issued to Stankowitz; U.S. Pat. No. 4,511,063 issued to Krause, et al.; U.S. Pat. No. 4,863,104 issued to Masterson; U.S. Pat. No. 4,948,054 issued to Mills; U.S. Pat. No. 5,415,351 issued to Otto, et al.; U.S. Pat. No. 5,727,736 issued to Tryon; and U.S. Pat. No. 5,979,797 issued to Castellano. A further example of an accessory is found in U.S. Pat. Applic. Public. No. 2002/0014563 of Lucero.

The aforecited patents and other devices known in the art generally provide means for relatively rapid delivery of material onto a desired surface. However, such devices have been problematic in that, for example, the artisan must perform the fatiguing and sometimes hazardous tasks of simultaneously holding and supporting the weight of the spray gun and supply hopper while spraying. Repetitive stress injuries are likely to occur.

Therefore, there exists a need for an ergonomic hopper holder which overcomes the drawbacks of the known devices, and which reduces fatigue and repetitive stress injuries.

SUMMARY OF THE INVENTION

An object of the present invention is to provide an ergonomic hopper holder which is simple to construct and use.

Another object of the present invention is to provide an ergonomic hopper holder which reduces fatigue in use.

A further object of the present invention is to provide an ergonomic hopper holder which reduces repetitive stress injuries.

In accordance with the present invention, an ergonomic hopper holder for use with spray application equipment includes a vertical support member having a holster end, an opposite hopper end, and a hopper hanger proximate to the hopper end. The holder also includes an arm member having a support end, a spray gun end, and a spray gun support proximate to the spray gun end for supporting a spray gun. The arm member is pivotably joined to the vertical support member. The holder further includes a holster and belt combination capable of being worn by an artisan.

DETAILED DESCRIPTION OF THE INVENTION

Figure 1:
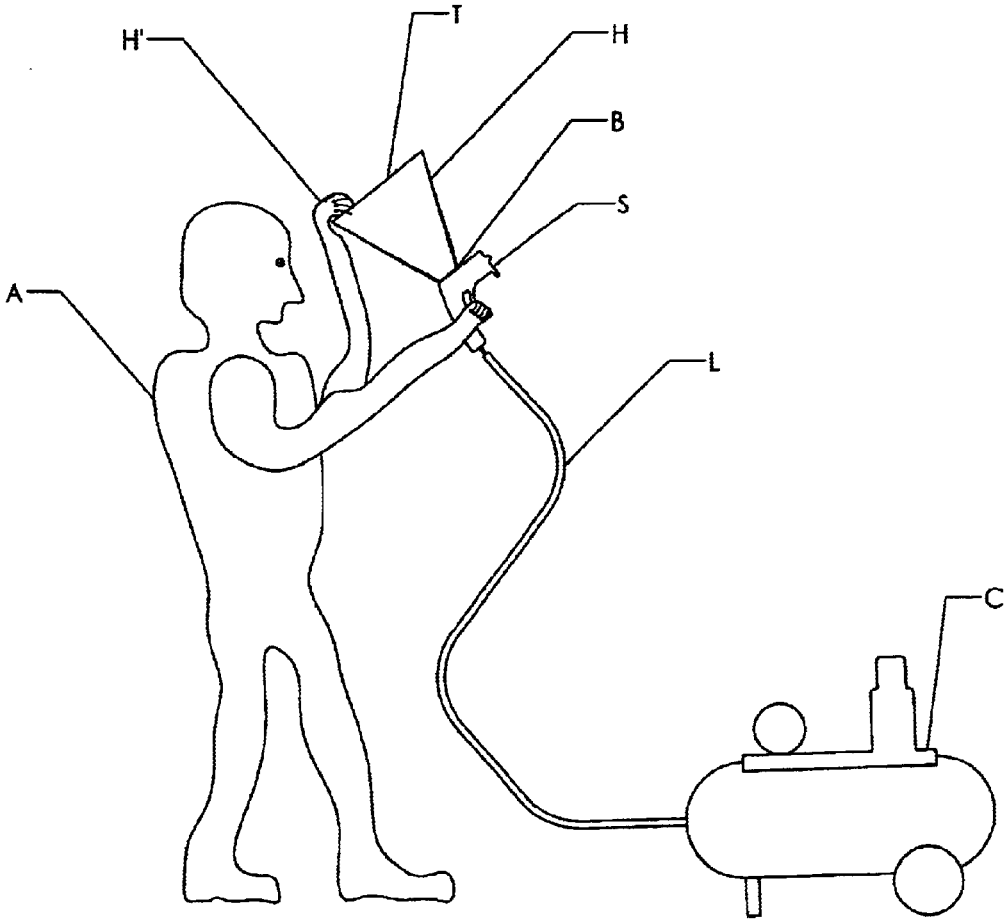
FIG. 1 ( PRIOR ART )
FIG. 1 is a perspective illustration of pneumatic spray application equipment of the prior art.

Referring to FIG. 1, typical pneumatic spray application equipment 100 for liquefied material (e.g., textured ceiling material) of the prior art is depicted. Equipment 100 includes a hand-held spray gun S for application of the liquefied material, along with a supply hopper H for containing a supply of liquefied material (not shown) having a top portion T and a bottom portion B. Spray gun S is coupled to bottom portion B of hopper H, such that the liquefied material may be fed from hopper H into gun S. Gun S is also pneumatically coupled via air line L to a source of pressurized air such as a portable air compressor C. In use, an artisan A grips spray gun S with one hand, while holding or steadying top portion T of hopper H with his other hand at handle H'. Artisan A then selectively depresses and holds a trigger (not shown) on gun S to cause pressurized air delivered from compressor C via line L to forcibly spray the liquefied material, being fed from hopper H into gun S, onto a desired surface.

By moving his body, limbs, and hands, artisan A aims the material being sprayed from gun S as desired for uniformly coating a surface. As aforedescribed, such movements become fatiguing to artisan A, particularly when hopper H is full and is therefore relatively heavy (typically, 20–25 lbs.) or when artisan A has been at work for an extended time.

Figure 2:
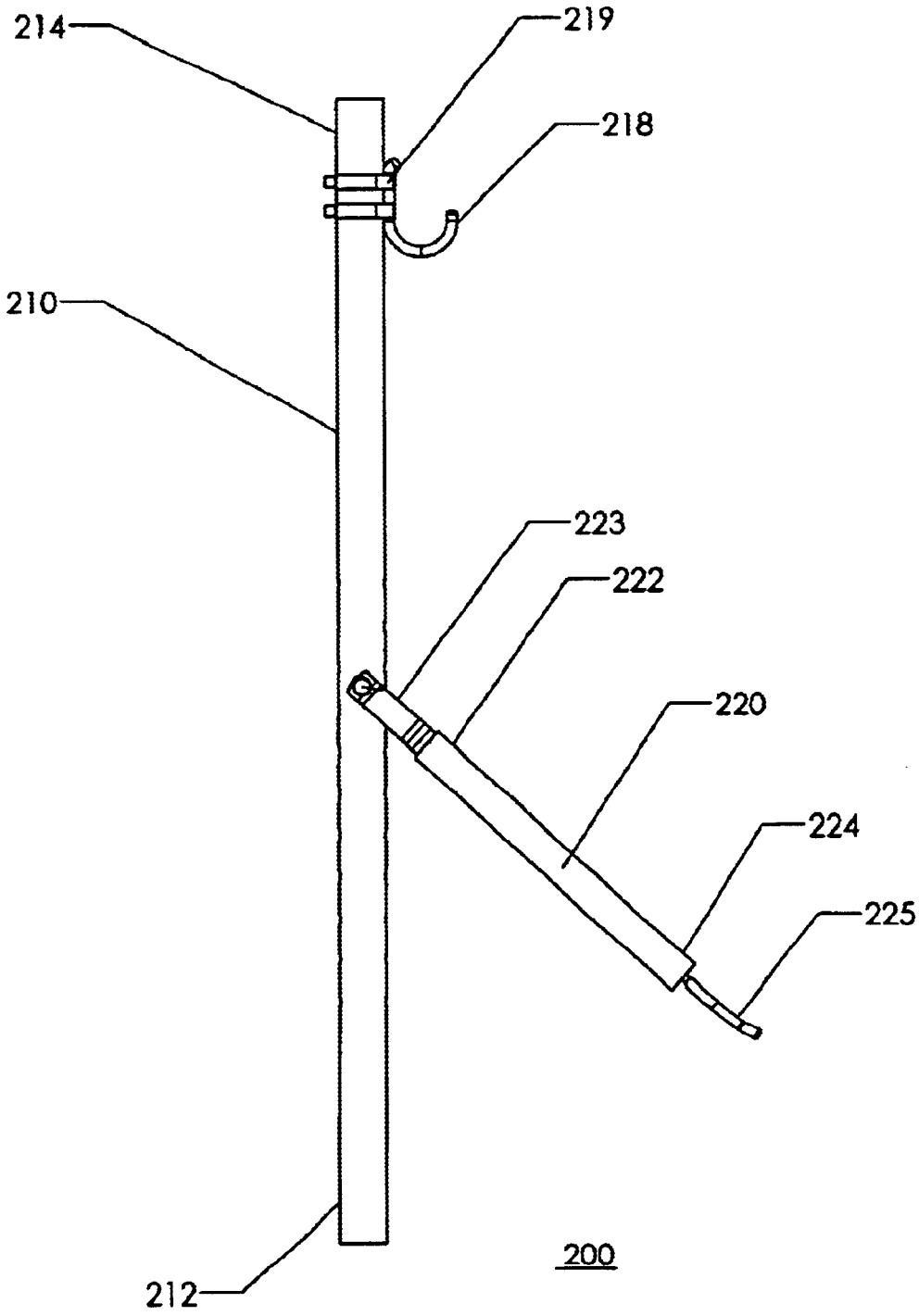
FIG. 2 is a perspective illustration of an ergonomic hopper holder, constructed in accordance with the present invention, before use.

Turning now to FIG. 2, there shown is an exemplary embodiment of an ergonomic hopper holder 200 of the present invention ("holder 200") before use. As depicted, holder 200 includes a vertical support member 210, and an arm member 220 pivotably coupled to vertical support member 210.

Vertical support member 210 includes a holster end 212 and an opposite hopper end 214. Member 210 also includes a hopper hanger 218 proximate to hopper end 214. Hopper hanger 218 may be securely coupled to member 210 by way of, for example, one or more commercially available pipe clamps 219.

Arm member 220 includes a support end 222 and a spray gun end 224. As aforesaid, arm member 220 is pivotably coupled to vertical support member 210, approximately midway between ends 212 and 214 of member 210, by way of conventional hinge hardware 223 at end 222 of arm member 220. Arm member 220 also includes a spray gun support 225 coupled to end 224. Like hanger 218, support 225 may be secured to member 220 by way of, for example, one or more commercially available pipe clamps, or it may be simply screwed or inserted into member 220 in a force-type fitting as shown.

Regarding compositions of the aforedescribed components of holder 200, vertical support member 210 and arm member 220 are preferably fabricated from commercially available PVC tubing. Alternatively, member 220 may be advantageously constructed from a simple, solid wood dowel.

Preferred dimensions of member 210 are about 41" in length by about 1.75" in diameter, while member 220 has preferred dimensions of about 12.5" in length by about 1.25" in diameter. Hanger 218 and support 225 may be any suitable commercially available symmetric utility hook, preferably having lengths of about 3.0" to 4.0", and diameters of about 0.5". Hanger 218, furthermore, may advantageously be bent or otherwise non-linear (not shown) to prevent it from slipping through clamps 219 when under a load.

Figure 3:
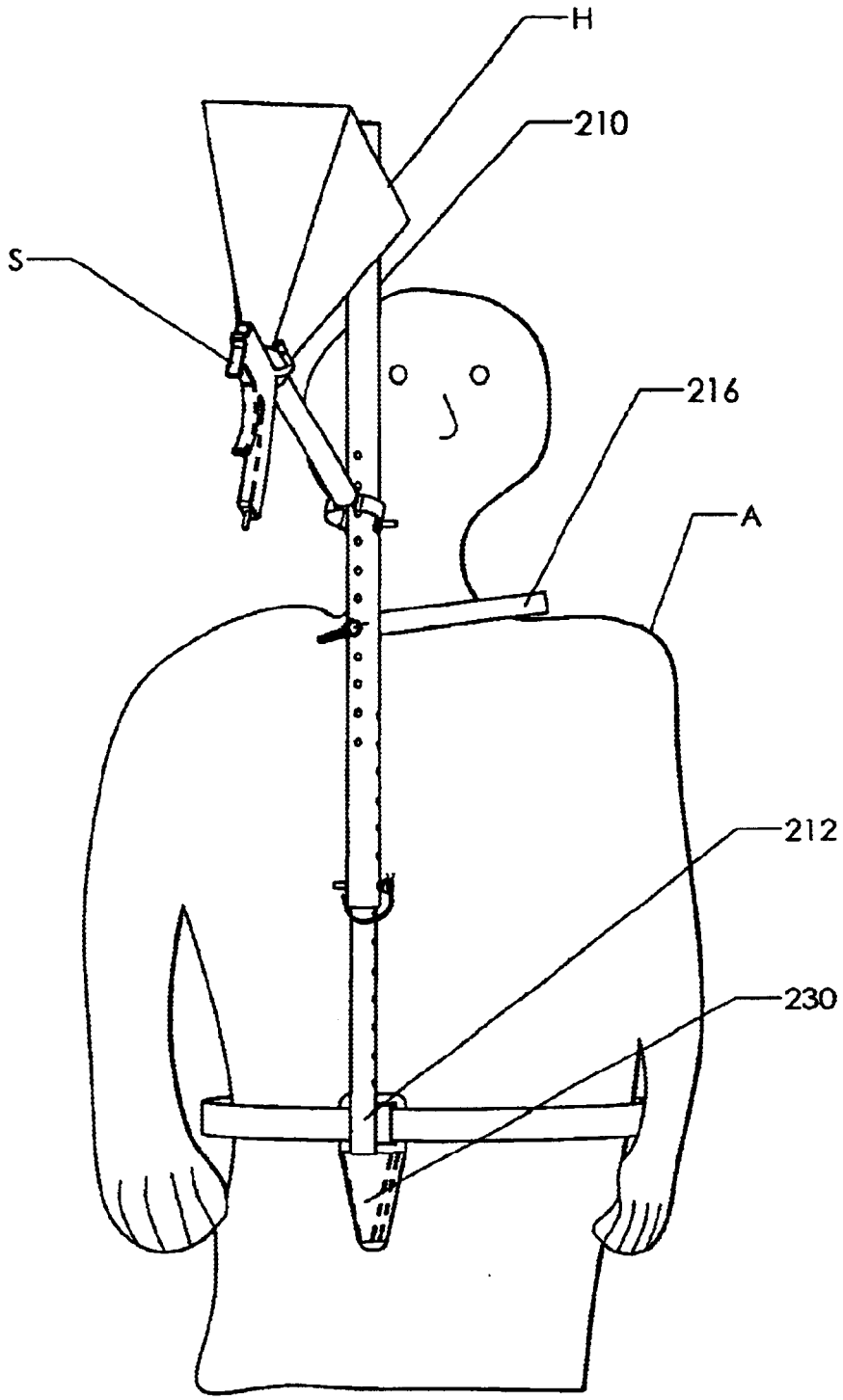
FIG. 3 is a perspective illustration of the ergonomic hopper holder of FIG. 2, ready for use.

Referring now to FIG. 3, holder 200 is depicted as being ready for use by artisan A. Holster end 212 of vertical support member 210 is securely held within a holster and belt combination 230 being worn around a waist of artisan A, as shown in the figure. An optional neck strap 216 may be coupled to vertical support member 210, if desired, to prevent movement of holder 200 when the hands of artisan A are at rest.

Figure 4:
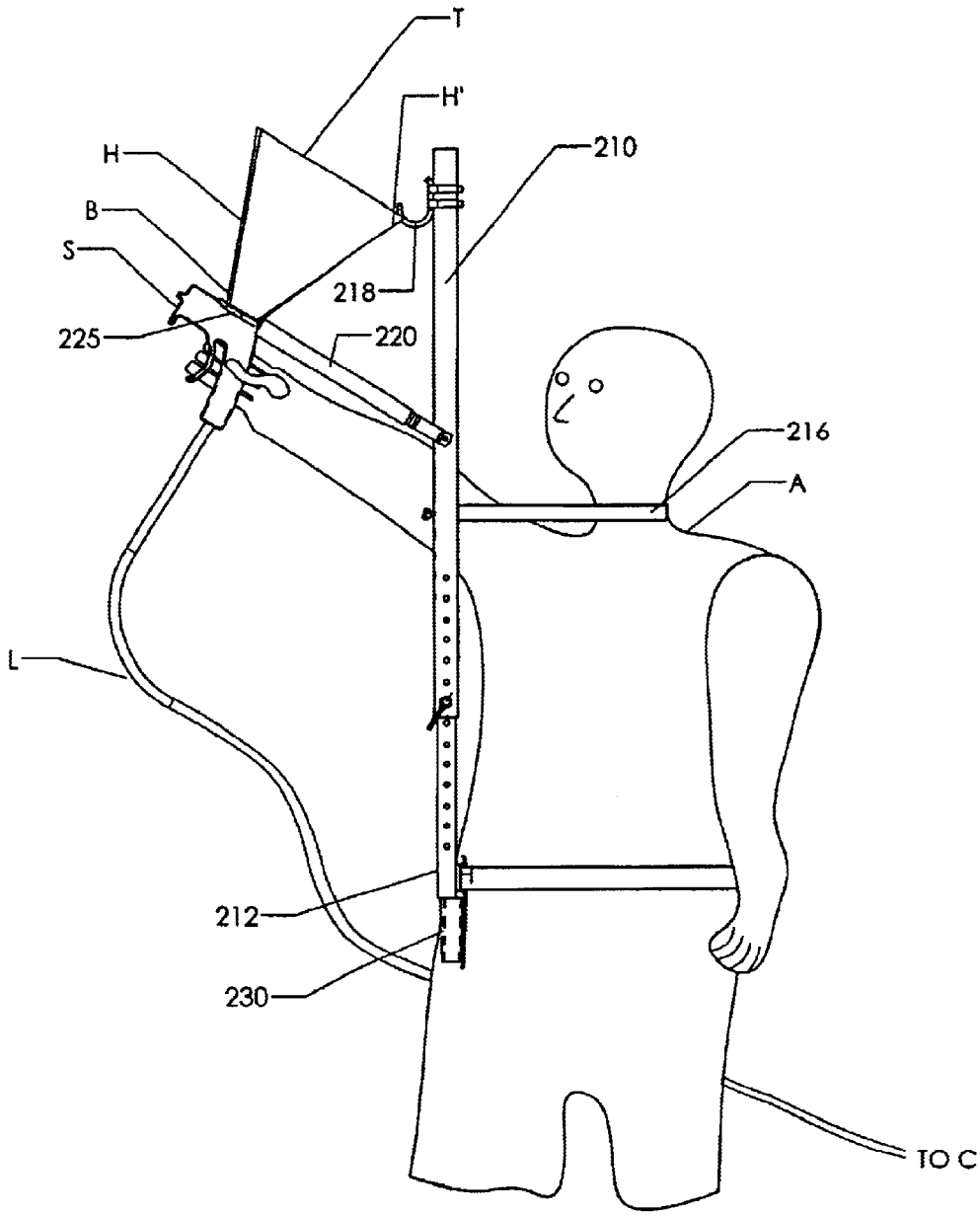
FIG. 4 is a perspective illustration of the ergonomic hopper holder of FIGS. 2 and 3, in use.

Turning now to FIG. 4, there shown is exemplary holder 200 in use by artisan A. As is to be appreciated with reference to the illustration, hanger 218 engages handle H' in top portion T of hopper H. Also, gun S is engaged by support 225 of pivotable arm member 220. Accordingly, a significant portion of the weight of the hopper H and gun S combination is borne by holder 200, through hanger 218 and support 225.

It is to be particularly appreciated that in the exemplary configuration of the present invention, the hand of artisan A which would otherwise be required to hold and steady hopper H at handle H' is free, thereby reducing fatigue and allowing the hand to be used for other purposes (e.g., holding another working tool or even a cellular telephone). Additionally, since arm member 220 is capable of pivoting about vertical support member 210, the elevation and orientation of gun S relative to a surface being sprayed may be easily manipulated by artisan A with minimal body movement. The beneficial ergonomic effects of use of holder 200, therefore, should be clearly understood.

Figure 5:
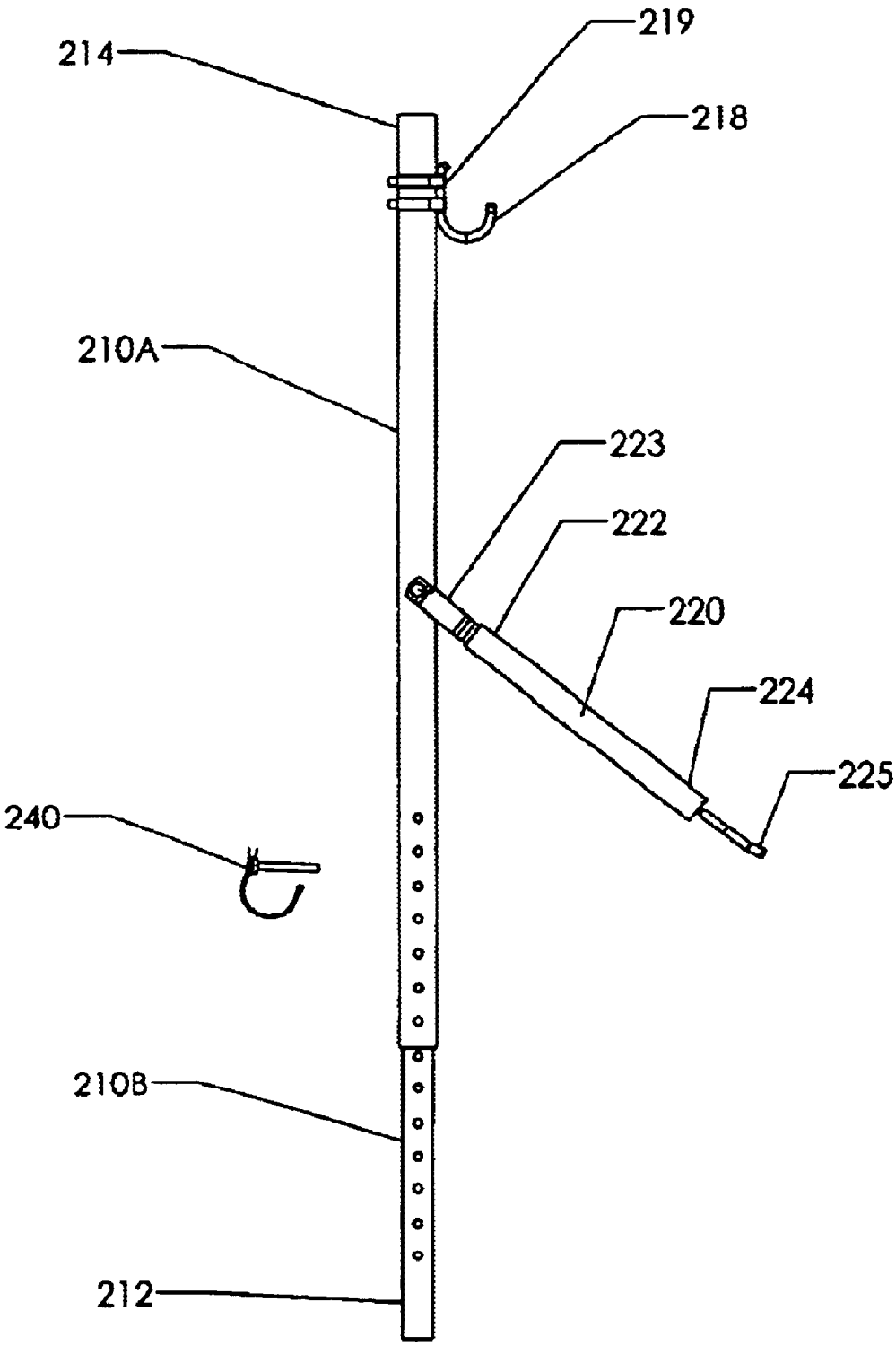
FIG. 5 is a perspective illustration of an alternative embodiment of the ergonomic hopper holder of FIG. 2, constructed in accordance with the present invention, before use.

FIG. 5 depicts an alternative exemplary embodiment of the present invention. Therein, vertical support member 210 of FIGS. 2–4 comprises a pair of telescoping, concentric tubes 210*a* and 210*b*. In this embodiment, tube 210*a* has preferred dimensions of about 41" in length by about 1.75" in diameter, while tube 210*b* has preferred complementary dimensions of about 19.5" in length by about 1.25" in diameter.

As shown in FIG. 5, tubes 210*a–b* each have at least one pair of corresponding holes, to receive a locking pin 240 inserted therethrough so that tubes 210*a–b* thereby maintain a desired length relationship. In such telescoping manner, tubes 210*a–b* provide an adjustable length feature to the aforedescribed vertical support member. It is to be particularly appreciated and understood, therefore, that artisans of dramatically differing heights and body shapes may all enjoy the benefits of use of the ergonomic hopper holder of the present invention.

While the present invention has been particularly shown and described with reference to the accompanying figures, it will be understood, however, that other modifications thereto are of course possible, all of which are intended to be within the true spirit and scope of the present invention. It should be appreciated that components of the invention aforedescribed may be substituted for other suitable components for achieving desired results, or that various accessories may be added thereto.

Lastly, the choice, of course, of compositions, sizes, and strengths of various aforementioned components of the present invention are all a matter of design choice depending upon intended uses thereof.

Accordingly, these and other various changes or modifications in form and detail of the present invention may also be made therein, again without departing from the true spirit and scope of the invention as defined by the appended claims.

What is claimed is:

1. An ergonomic hopper holder, for use with spray application equipment wherein the spray application equipment includes a source of pressurized air, a pressurized air line coupled to the source, a spray gun pneumatically coupled to the air line, and a supply hopper coupled to the gun, said ergonomic hopper holder comprising:

a vertical support member having a holster end and an opposite hopper end, said vertical support member further including a hopper hanger proximate to said hopper end;

an arm member having a support end and a spray gun end, said arm member further including a spray gun support proximate to said spray gun end for supporting a spray gun, said arm member being pivotably joined to said vertical support member; and a holster and belt combination capable of being worn by an artisan, wherein in use of said ergonomic hopper holder, (i) said holster end of said vertical support member is inserted into said holster, (ii) the hopper is engaged by said hopper hanger, and (iii) the spray gun is engaged by said spray gun support.

2. The ergonomic hopper holder of claim 1, further including a neck strap coupled to said vertical support member.

3. The ergonomic hopper holder of claim 1, wherein said vertical support member comprises at least a pair of telescoping concentric tubes and a locking pin provided therethrough, whereby said tubes are capable of being maintained in a desired length relationship.

* * * * *